US008905657B2

(12) United States Patent
Grunenberg et al.

(10) Patent No.: US 8,905,657 B2
(45) Date of Patent: Dec. 9, 2014

(54) MARKING OBJECT AND MARKING APPARATUS

(75) Inventors: Georg Grunenberg, Detmold (DE); Thorsten Diessel, Hiddenhausen (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 614 days.

(21) Appl. No.: 12/671,330

(22) PCT Filed: Jul. 17, 2008

(86) PCT No.: PCT/EP2008/005855

§ 371 (c)(1), (2), (4) Date: Mar. 22, 2010

(87) PCT Pub. No.: WO2009/015781

PCT Pub. Date: Feb. 5, 2009

(65) Prior Publication Data

US 2010/0189488 A1 Jul. 29, 2010

(30) Foreign Application Priority Data

Jul. 31, 2007 (DE) ..... 10 2007 036 374

(51) Int. Cl.

| | |
|---|---|
| ***B41J 11/44*** | (2006.01) |
| ***B41F 17/00*** | (2006.01) |
| ***B41J 11/00*** | (2006.01) |
| ***B41J 3/407*** | (2006.01) |
| ***B41J 13/10*** | (2006.01) |
| ***B41J 3/44*** | (2006.01) |
| ***B41J 11/46*** | (2006.01) |
| ***B41J 11/06*** | (2006.01) |
| ***B41J 3/28*** | (2006.01) |

(52) U.S. Cl.

CPC ..... *B41J 3/407* (2013.01); *B41J 11/009* (2013.01); *B41J 3/4073* (2013.01); *B41J 13/10* (2013.01); *B41J 3/44* (2013.01); *B41J 11/46* (2013.01); *B41J 11/06* (2013.01); *B41J 3/4075* (2013.01); *B41J 3/28* (2013.01)

USPC ..... 400/76; 101/41; 101/43; 101/44

(58) Field of Classification Search

USPC ..... 347/8; 283/79; 101/41–44

See application file for complete search history.

(56) References Cited

U.S. PATENT DOCUMENTS

| | | | | |
|---|---|---|---|---|
| 5,242,053 | A * | 9/1993 | Rowe | 206/446 |
| 6,523,921 | B2 * | 2/2003 | Codos | 347/8 |
| 6,672,694 | B2 | 1/2004 | Shimizu | |
| 6,802,659 | B2 | 10/2004 | Cremon et al. | |

(Continued)

FOREIGN PATENT DOCUMENTS

DE 10 2006 003 056 A1 7/2007

*Primary Examiner* — Matthew G Marini

(74) *Attorney, Agent, or Firm* — Roberts Mlotkowski Safran & Cole, P.C.; David S. Safran

(57) ABSTRACT

A marking object having at least one object blank (3) and held by an object carrier (2), the object blank (3) being markable by a marking apparatus (7). To configure the marking objects such that the known drawbacks are eliminated, the object carrier (2) has at least one identification means (4*a*, 4*b*, 4*c*, 4*d*) that contains at least one piece of information relating to the marking object (1) and/or the identification means (4*a*, 4*b*, 4*c*, 4*d*) can be used to store at least one piece of information relating to the marking object (1).

11 Claims, 5 Drawing Sheets

(56) References Cited

U.S. PATENT DOCUMENTS

| | | | | |
|---|---|---|---|---|
| 7,223,030 | B2 * | 5/2007 | Fessler et al. | 400/76 |
| 2004/0205940 | A1 * | 10/2004 | Cooper et al. | 24/16 PB |
| 2007/0120932 | A1 | 5/2007 | Miura | |
| 2007/0171447 | A1 * | 7/2007 | Schoedinger et al. | 358/1.12 |
| 2010/0220162 | A1 * | 9/2010 | Schierholz et al. | 347/102 |

* cited by examiner

MARKING OBJECT AND MARKING APPARATUS

BACKGROUND OF THE INVENTION

1. Field of Invention

The invention relates to a marking object with at least one object carrier and at least one object blank held by the object carrier, the object being markable by a marking device. Furthermore, the invention also relates to a marking device for marking such a marking object with at least one marking unit, at least one marking object holding device and at least one defined or definable marking pattern, the marking unit and the marking object holding device being movable relative to one another in the main transport direction.

2. Description of Related Art

Marking objects of the type under consideration have long been known and are used in industrial and commercial practice, often within the framework of housing and connection identifications, for example, in the form of labels, of self-adhesive or clip-in identification strips, in the form of identification cards, notch strips, stick-in tags, tag plates, clamp strips, marking sleeves, marking tags or other molded articles. These objects are generally held in a larger number of items by the object carrier. For molded articles, the object carriers are often frames, for example, of plastic, the object being joined to the object carrier which is made as a frame by way of a crosspiece which constitutes a scored site. By separating the crosspiece, the molded part can then be released from the object carrier.

For flat object blanks, therefore especially for labels or marking tags, several labels or marking tags are located next to one another on a flat object carrier, often a flat, coated paper web or preferably a plastic injection molding.

The marking objects for marking of the object are conventionally inserted into a marking device or into a marking object holding device of the marking device and are drawn in by the marking device, whereupon the object blanks are provided with a marking pattern, generally alphanumeric characters. The marking unit responsible for the actual marking is generally a printer or a printing head which performs marking by applying ink. These printers have been known for a long time, the printer generally being intended for printing on paper. A printer with which marking objects of plastic which have several marking tags as the object blanks can be printed is known, for example, from German Patent Application DE 10 2006 003 056 A1.

However, the marking unit can also be a pressing or engraving tool which by applying pressure or by metal cutting delivers the given marking pattern into the respective object blank.

The marking of a marking object with known marking devices is subject to some disadvantages. For example, in practice, often only a few of the objects encompassed by the marking object are needed at the same time so that marking objects are only partially marked in one pass, i.e., only some of the object blanks are marked, and the marking objects with the remaining unmarked object blanks are generally not further used, but are disposed of unused as scrap.

Furthermore, in the operation of a marking device, it must be accurately watched that the marking objects are held and guided in the uniquely correct orientation by the marking object holding device since the marking pattern otherwise is incorrectly applied to the marking object. In particular, for asymmetrical marking objects or object blanks located asymmetrically in the object carrier, misalignment of the marking object in the marking object holding device leads to faulty marking of the object blanks which then can no longer be further used.

Therefore, when using different marking objects, for example, when using marking objects of different manufacturers or also only when using different types of marking objects, suitable set-up—parameterization—of the marking device must be observed. This parameterization conventionally comprises consideration of the material comprising the marking object because, for example, it dictates how thickly the ink is applied when executing the marking, or for example, also with what temperature the inscribed object should be subsequently dried or with which irradiation intensity the object should be irradiated. Faulty parameterization of the marking device, therefore parameterization which does not consider the particulars of the marking object used, likewise leads to the marking objects not being correctly marked and only becoming scrap.

SUMMARY OF THE INVENTION

The object of this invention is, therefore, to avoid the indicated disadvantages of known marking objects and of known marking devices for marking of marking objects, at least in part.

This object is achieved, first of all, in accordance with the invention for the marking objects under consideration in that the object carrier comprises at least one identification means, the identification means containing at least one item of information relating to the marking object and/or at least one item of information relating to the marking object being able to be stored in the identification means. The configuration of the marking object in accordance with the invention results in that the information relating to the marking object is linked or can be linked directly to the marking object so that the information necessary for correct marking of the marking object or of the object blanks of the marking object can be obtained from the marking object itself or can be filed on the marking object itself.

In one configuration of the invention, the identification means performs inscribing and/or engraving and/or embossing and/or in perforation of the object carrier, this configurations being especially suitable for more valuable marking objects since they can be provided easily and at low cost. In particular, for high quality marking objects and object blanks, the use of electronic data media as the identification means is also advantageous, especially so-called RFID (radio frequency identification) chips or magnetic strips enabling contactless reading and storage of information in the identification means; this is of great benefit mainly for sensitive marking objects.

In one preferred embodiment, the object carrier has at least one crosspiece, the identification means at least partially being provided on the crosspiece of the object carrier. However, two crosspieces which run essentially parallel to one another are especially advantageous, these crosspieces then being provided mainly such that, for proper use of the marking object in a marking device, the crosspieces point in the main transport direction of the marking object. In this configuration, the crosspieces can also be used at the same time to make positive or nonpositive contact with the marking object by the transport device of the marking device—for example, driven rolls which press against one another—and to transport the marking object in the main transport direction.

It is especially advantageous if there are several identification means on the object carrier of the marking object such that the item of information of at least one of several identification means can be detected regardless of the orientation of the marking object and the information can be stored in at least one of several identification means regardless of the orientation of the marking object.

In one advantageous configuration of the invention, the item of information of the identification means relating to the marking object is the manufacturer identification and/or the type identification, with which the manufacturer of the marking object and the type of marking object can be easily determined. The type identification can be an "abstract" type which does not comprise concrete data such as, for example, the type of material used for the object blanks. In this case, "concrete" information for describing the marking object of the pertinent type can be determined only by comparison with a database which can be encompassed, for example, by the marking device.

In another advantageous configuration of the invention, the item of information of the identification means relating to the marking object—symmetry identification—indicates whether the marking object is symmetrical or asymmetrical. A marking object is called symmetrical when the object blank is held or located symmetrically on the object carrier so that the three-dimensional arrangement of object blank at a fixed point does not change when the marking object is turned by 180°. This information can be, for example, used specifically for monitoring the correct feeding of a marking device with the marking objects in accordance with the invention. If the marking object is symmetrical, it is irrelevant with which of the two face sides the marking object is introduced into the marking device, i.e., which of the two face sides is forward when viewed in the main transport direction.

In this connection, it has been found to be especially advantageous if the marking object is made such that the item of information of the identification means relating to the marking object describes the orientation of the marking object, especially indicates whether the identification means is on the front or back of the marking object and/or on which side of the front and/or back of the marking object the identification means is located. By this measure, the orientation of the marking object can be very easily detected from the outside, by which it can be assessed whether the marking object is suitably aligned for further processing.

In one especially preferred embodiment of a marking object in accordance with the invention, the identification means is set up such that the item of information regarding which object blank has been marked or which object blank has not yet been marked is stored or can be stored in it (object blank identification). This advantageous configuration of the invention allows a suitable marking device to properly mark even already partially marked marking objects or marking objects with object blanks already removed. In this way, the marking objects which have only some of the originally present object blanks can also be further used.

In another advantageous configuration, it is also provided that the identification means is provided on the outer edge of the object carrier, especially specifically on the outer edge with which the marking object in proper use can be introduced first into the marking device. This ensures that the information relating to the marking object is being detected while the marking object is still being positioned.

The initially described object is also achieved in accordance with the invention in the marking device under consideration by at least one detection and/or influencing device being provided for interaction with the identification means, and by way of the detection and/or influencing means, at least one item of information relating to the marking object can be detected and/or at least one item of information relating to the marking object can be stored in the identification means. Because the marking device in accordance with the invention is suitable for using the marking objects in accordance with the invention in the proper manner, specifically such that the information which is to be stored or which is contained in the identification means of the marking object can be detected or stored, the information described above in conjunction with the marking object in accordance with the invention can be used for processing of the marking object in the marking device in the aforementioned advantageous manner.

In one preferred configuration of the marking device, it is provided that, before marking of the object blanks of the marking object, the item of information relating to the marking object is detected and held by the detection and/or influencing means, especially specifically the manufacturer identification and/or the type identification and/or the orientation and/or the item of information about the marked or unmarked object blanks (object blank identification) of the marking object is detected and held by the detection and/or influencing means.

Here, if the point is that the item of information relating to the marking object can be detected by the detection and/or influencing means, specifically by "interaction" with the identification means, this of course presupposes that the marking device somehow encompasses a type of data processing means. This goes without saying and does not require further explanation. In exactly the same way, it goes without saying that such a data processing means is used altogether for implementation of the functionality described here and for corresponding control of the marking device. For example, if the point is that, with the detection and/or influencing means, the item of information relating to the marking object is detected and held, thus technically the use of a data processing means with which the described functionality is implemented is meant. Both an item of information of an identification means can be read out by the detection and/or influencing means, and the item of information can be written into the identification means, i.e., stored in it, and an item of information which has been read out of the identification means can be evaluated and stored by the data processing means.

In one preferred embodiment, the detected and stored item of information relating to the marking object is used in the marking device for parameterization and control of the marking unit. This means especially that, for example, the item of information relating to the orientation of the object blanks leads to suitable alignment—especially rotation—and/or scaling of the marking pattern so that marking of the object blanks can be carried out independently of the location in the marking object in the marking object holding device. By detecting the orientation of the object blank or blanks, the marking device can adapt the given marking pattern such that the marking can be corrected applied to the intended object blank. Misalignment of the marking objects is accordingly no longer possible in the marking device in accordance with the invention since the marking device adapts the marking pattern which is present in an electronic data format to the detected alignment of the marking object by a corresponding transformation. These transformations of video data—for example, translation, rotation, mirroring—are conventionally known.

According to another advantageous embodiment of the marking device, it is provided that the detected and stored item of information relating to the marked or unmarked object blanks of the marking object (object blank identification) be used for triggering of the marking unit and/or for adaptation of the marking pattern, specifically such that only unmarked object blanks are marked by the marking unit. The marking device made in this way also makes it possible to re-use even partially used marking objects, i.e., marking objects in which only some of the object blanks are marked. The marking device is specifically able to obtain information about which object blanks of the marking object are still present and still unmarked and/or which object blanks are no longer present or have already been marked. The marking device in accordance with the invention can recognize by comparison of this item of information with the defined or definable marking pattern which parts of the defined marking pattern at the corresponding position can no longer be marked, and it is therefore possible for the marking device to react to such a collision. This can take place either by the marking unit not undertaking any marking on the position of the already marked object blanks or by the defined marking pattern being adapted, for example, by no longer markable positions of object blanks being shifted to still markable positions of still unmarked object blanks.

In particular there is still a host of possibilities for embodying and developing the marking object in accordance with the invention and the marking device in accordance with the invention as will be apparent form the following description of embodiments in conjunction with the accompanying drawings.

DETAILED DESCRIPTION OF THE INVENTION

Figure 1:
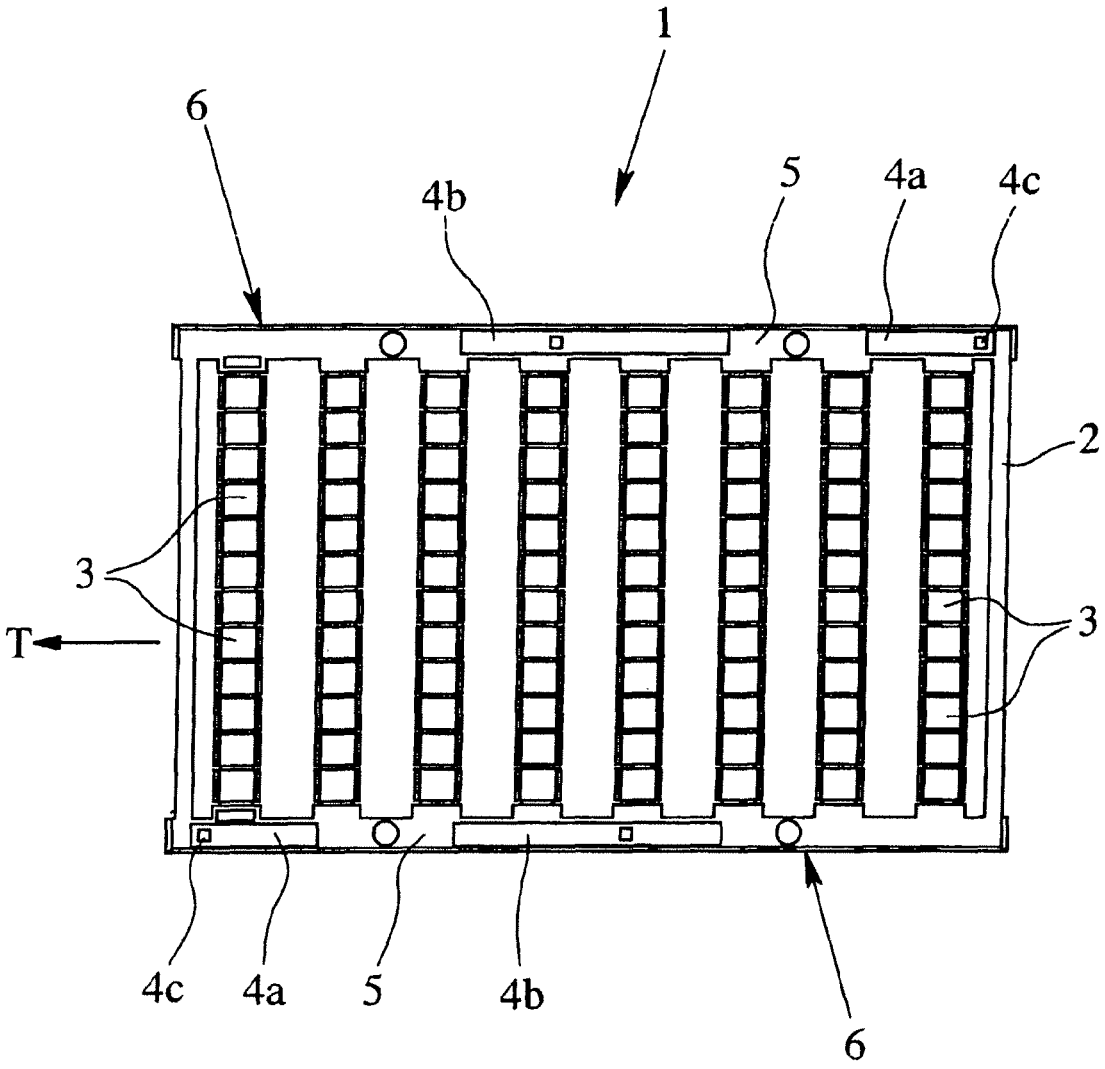
FIG. 1 shows one exemplary embodiment of a marking object in accordance with the invention in a plan view.
Figure 2:
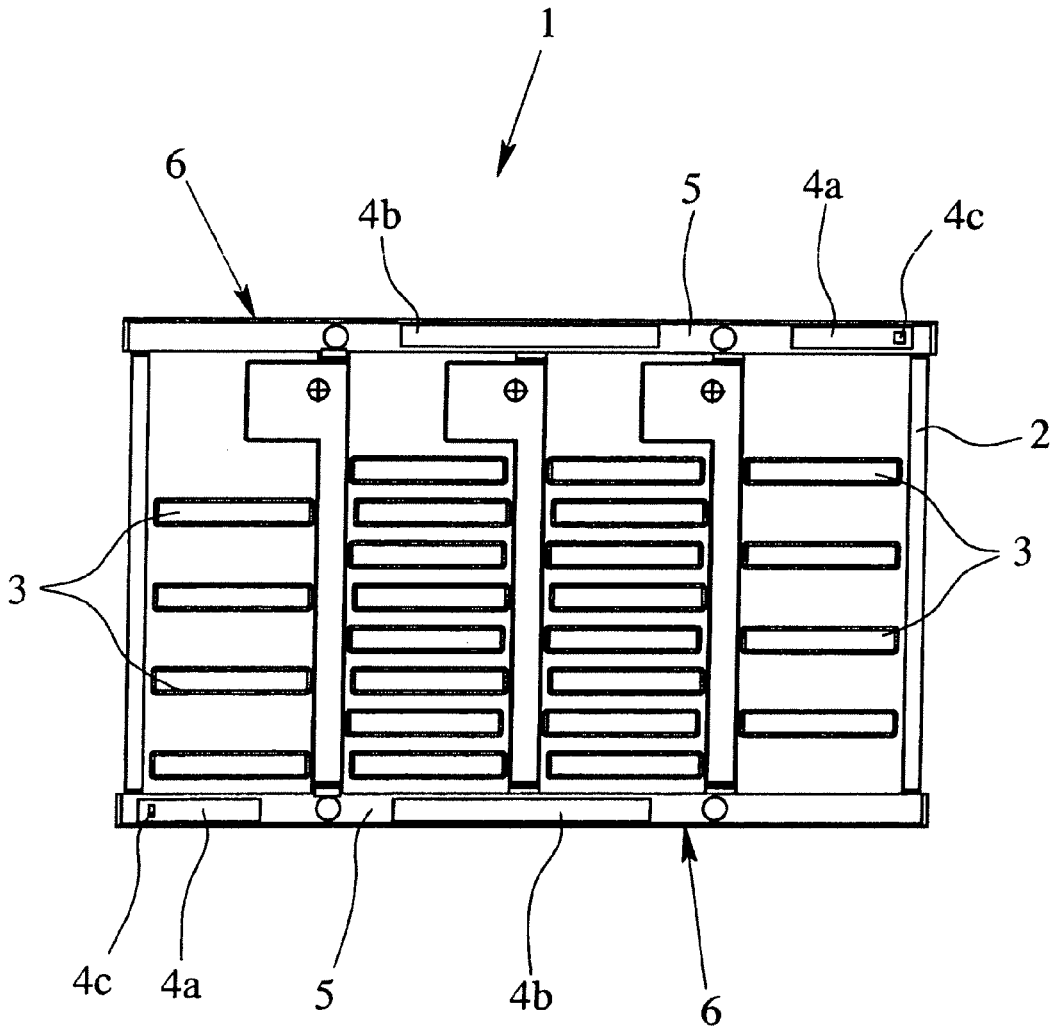
FIG. 2 shows another exemplary embodiment of a marking object in accordance with the invention in a plan view.
Figure 3:
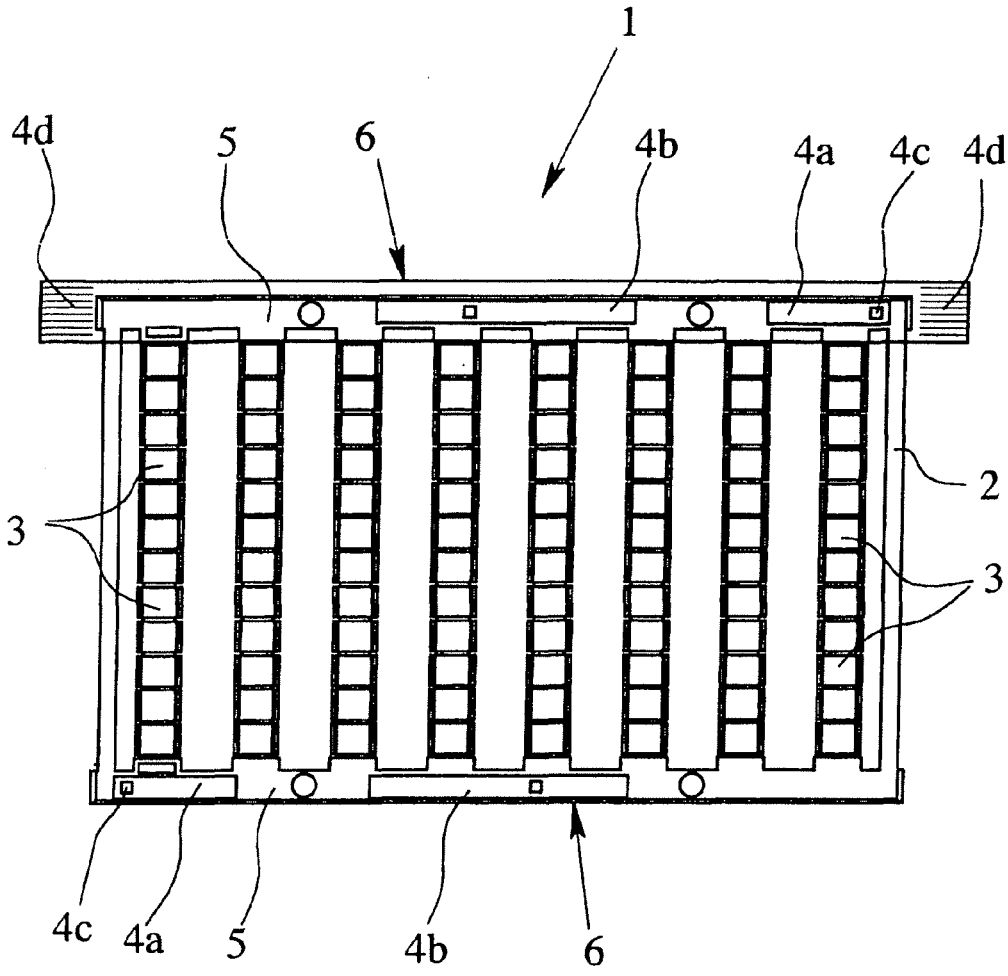
FIG. 3 shows still another exemplary embodiment of a marking object in accordance with the invention in a plan view.

FIGS. 1 to 3 each show a marking object 1 with an object carrier 2 and several object blanks 3 which are held by the object carrier 2. In FIGS. 1 and 3, the object blanks 3 are arranged symmetrically in columns; conversely, the object blanks 3 in FIG. 2 are arranged asymmetrically. The marking object 1 shown in FIGS. 1 and 3 is thus made symmetrically, i.e., it is irrelevant with which of the two face sides the marking object 1 is introduced into the marking device 7. In contrast, the marking object 1 shown in FIG. 2 is asymmetrical so that in the marking of the object blanks 3, it must be considered with which face side the marking object 1 is introduced into the marking device 7. The object blanks 3 can be marked by the marking device which is shown only in FIG. 4.

The marking objects 1 shown in the figures are each made such that the object carrier 2 comprises several identification means (4*a*, 4*b*, 4*c*, 4*d*), the identification means (4*a*, 4*b*, 4*c*, 4*d*) containing at least one item of information which relates to the marking object 1. In the marking object 1 shown in FIG. 3, an item of information relating to the marking object 1 can also be stored in the identification means 4*d*.

It can be recognized in FIGS. 1 to 3 that the object carrier 2 comprises two crosspieces 5 which run essentially parallel to one another, the identification means (4*a*, 4*b*, 4*c*, 4*d*) being provided on the crosspieces 5 of the object carrier 2. The crosspieces 5 here run parallel to the main transport direction T in which the marking object 1 is inserted into the marking device 7.

The marking objects 1 shown in FIGS. 1 to 4, likewise, have in common that there are several identification means (4*a*, 4*b*, 4*c*, 4*d*) on the object carrier 2 such that the information of at least one of several identification means (4*a*, 4*b*, 4*c*, 4*d*) can be detected independently of the orientation of the marking object 1. For example, it can be recognized that the identification means 4*a* and the identification means 4*c* are located in each of opposite corners of the marking object 1 so that, when using the marking object 1, it is irrelevant with which of its two face sides the marking object is introduced, for example, into a marking device. The same also applies to the identification means 4*b* which are provided on opposite locations on the crosspieces 5.

In the illustrated embodiments, the item of information of the identification means (4*a*, 4*b*, 4*c*, 4*d*) relating to the marking object 1 is a manufacturer identification 4*a* and a type identification 4*b*. Furthermore, there is also a symmetry identification 4*c* which indicates whether the marking object 1 or the arrangement of object blanks 3 on the marking object 1 is symmetrical or asymmetrical. In the embodiments shown in FIGS. 1 to 3, the symmetry identification 4*c* is in opposite perforations, the perforations for a symmetrical marking object 1 being square and of the same size (FIGS. 1 and 3), and for the asymmetrical marking object 1 as shown in FIG. 2 their being of different size so that altogether it can be recognized that there is asymmetry and which of the different face sides of the marking object 1 is in fact being detected.

Marking objects which are not shown here are characterized in that the item of information of the identification means relating to the marking object describes the orientation of the marking object, specifically especially indicates whether the identification means is on the front or back of the marking object and/or on which side of the front and/or back of the marking object the identification means is located.

The embodiment as shown in FIG. 3 is characterized in that the identification means is an object use identification 4*d* which is set up such that the information as to which of the object blanks 3 has been marked or which object blanks 3 has not yet been marked is stored or can be stored in it. In this way, it is fundamentally possible to mark incompletely marked marking objects 1 by a suitably equipped marking device such that only the still unmarked object blanks 3 are used.

In the illustrated embodiments the identification means (4*a*, 4*b*, 4*c*, 4*d*) are on the outer edge 6 of the object carrier 2 so that it is easily established at what locations of the marking object 1 the information of the identification means (4*a*, 4*b*, 4*c*, 4*d*) can be read off and stored. The illustrated marking objects 1 are preferably made as plastic injection moldings and the object blanks 3 as marking tags for electrical or electronic devices, and the marking tags can preferably be locked or inserted in the corresponding recesses on the housings of the devices.

Figure 4:
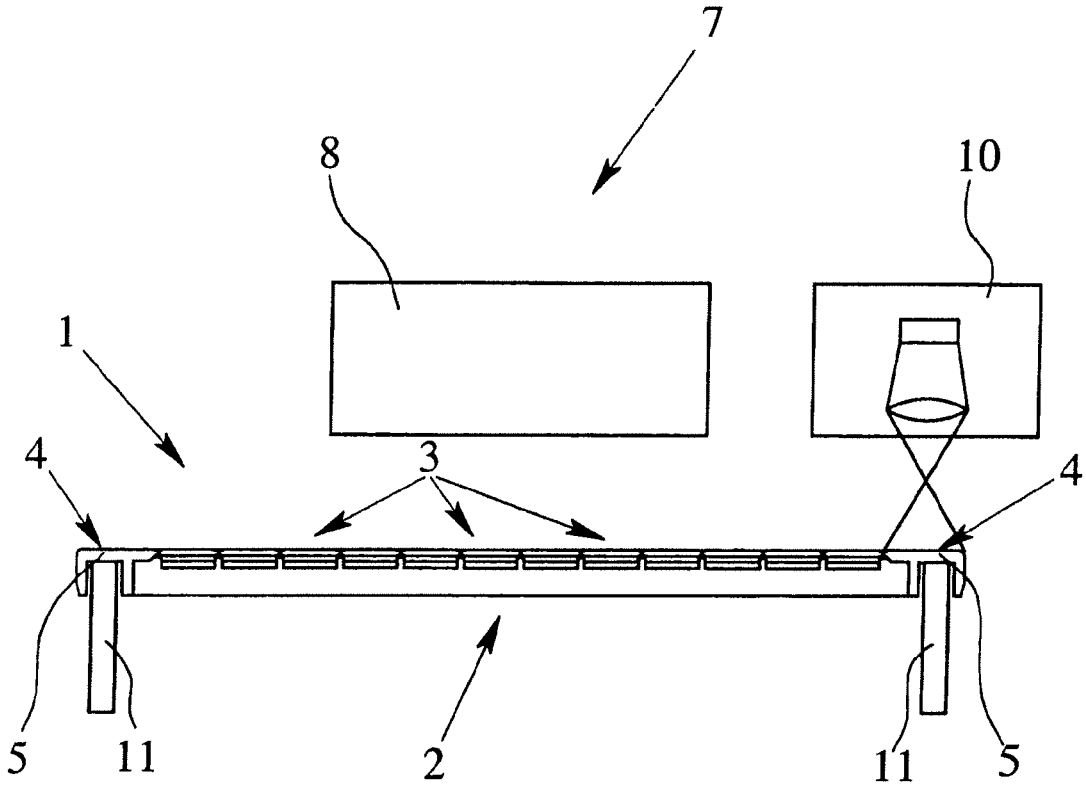
FIG. 4 shows a schematic of one exemplary embodiment of a marking device in accordance with the invention in a side view and FIG. 5 shows a perspective of a printer as a marking device.

FIG. 4 partially shows a marking device 7 for marking of at least one marking object 1. The marking device 7 comprises a marking unit 8 and a marking object holding device 9 which are both shown in FIG. 5. The marking device 7 also comprises a marking pattern with which the object blanks 3 are to be identified. The marking unit 8 and the marking object holding device 9 can be moved relative to one another in a main transport direction T, the main transport direction T, in the illustrated exemplary embodiment, into the plane of the paper in FIG. 4. The marking object 1 used is one of the above described marking objects 1 with an object carrier 2 and several object blanks 3 which are held by the object carrier 2, the object carrier 2 comprising identification means 4.

For interaction with the identification means 4, there is a detection and/or influencing device 10, and by way of the detection and/or influencing device 10, an item of information relating to the marking object 1 can be detected and an item of information relating to the marking object 1 can be stored in the identification means 4.

The marking device 7 is also characterized by the item of information relating to the marking object 1 being detected and stored before marking of the object blanks 3 of the marking object 1 with the detection and/or influencing device 10. This item of information or the detected information in the illustrated embodiment is the manufacturer identification 4*a*, the type identification 4*b*, the symmetry identification 4*c* and the object blank identification 4*d*.

In the illustrated marking device 7, the detected and stored information relating to the marking object 1 is used for parameterization and control of the marking unit 8; this makes the illustrated marking device 7 especially advantageous since the information belonging to the actually used marking object 1 is necessarily always used.

In the illustrated embodiment, the information relating to the orientation of the object blanks 3 is used for suitable alignment—especially specifically rotation—and scaling of the marking patterns so that marking of the object blanks 3 can be carried out independently of the position of the marking object 1 in the marking object holding device 9. In particular, the detected and held information relating to the marked or unmarked object blanks 3 of the marking object 1—object use identification—is used for triggering of the marking unit 8 or also for adaptation of the marking pattern so that only unmarked object blanks 3 are marked by the marking unit 8.

Finally, the marking device 7 shown in FIG. 4 is characterized in that the marking device 7, in the identification means 4, stores or updates the information regarding which object blanks 3 have been marked by the marking unit 8.

Figure 5:
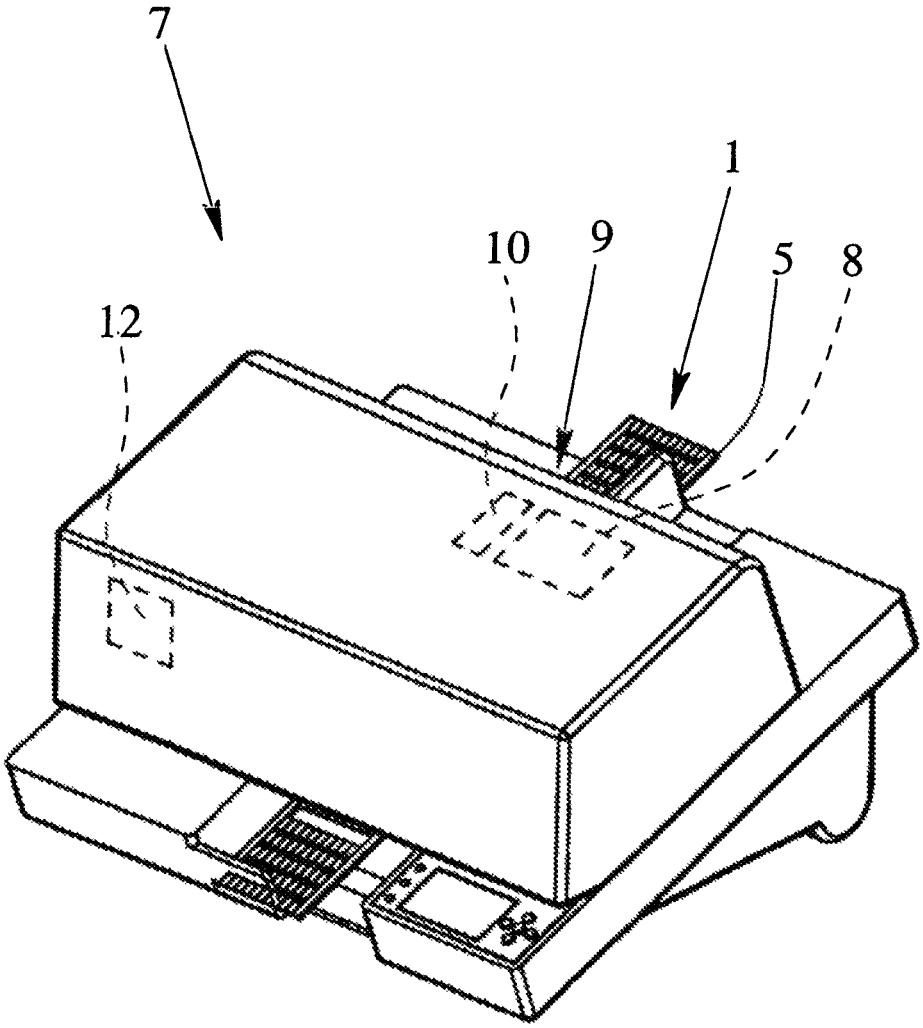

FIG. 5 shows a printer which is used as the marking device 7 and which can be an inkjet printer. The printer 7 has a printing head which is only suggested here as the marking unit 8 and a marking object holding device 9. The marking object holding device 9 is used both for holding and also for transport of the marking object 1 to be marked in the main transport direction. For transport of the marking object 1 through the marking device 7 there can be several rollers 11 (which are only suggested in FIG. 4) in the marking device 7, and which are aligned with one another such that they make positive and nonpositive contact with the crosspieces 5 of a marking object 1 which has been inserted into the marking object holding device 9, and thus, transport the marking object 1 in the main transport direction. FIG. 5 also shows a data processing means 12 which interacts with the detection and/or influencing device 10.

What is claimed is:

1. Marking device for marking at least one marking object further comprising:

at least one marking unit, at least one marking object holding device adapted for holding a marking object comprised of a plurality of object blanks that are detachably connected together and held by an object carrier as parts of a single plastic unit, and at least one defined or definable marking pattern, wherein the marking unit and the marking object holding device are movable relative to one another in a main transport direction, wherein, for interaction with identification means on the object carrier, a device for at least one of detection and influencing at least one item of information relating to the marking object is provided, wherein by way of the device at least one item of information relating to the marking object can be detected and/or wherein by way of the device at least one item of information relating to the marking object can be stored in the identification means, and wherein, before marking of an object blank or blanks, the marking unit is responsive to detection of information relating to marked or unmarked status of the connected object blanks of the marking object so that only unmarked object blanks are marked by the marking unit.

2. Marking device as claimed in claim 1, wherein before marking of the object blanks of the marking object, the item of information relating to the marking object is detected and held by the detection and/or influencing means.

3. Marking device as claimed in claim 2, wherein the detected and stored item of information relating to the marking object is of a type enabling parameterization and control of the marking unit.

4. Marking device as claimed in claim 1, wherein the item of information relating to the orientation of the object is of a type enabling alignment of the marking pattern so that marking of the object blanks is performable independent of the position of the marking object in the marking object holding device.

5. Marking device as claimed in claim 4, wherein the marking unit is responsive to detection of information relating to marked or unmarked status of the object blanks so that only unmarked object blanks are marked by the marking unit.

6. Marking device as claimed in claim 1, wherein the item of information relating to the marked or unmarked object blanks of the marking object is used for at least one of triggering of the marking unit and adaptation of the marking pattern, such that only unmarked object blanks are marked by the marking unit.

7. Marking device as claimed in claim 1, wherein the device for at least one of detection and influencing stores or updates information as to which object blanks has been marked in the identification means.

8. Marking device as claimed in claim 1, wherein, before marking of an object blank or blanks, the marking unit is responsive to detection of information relating to whether the arrangement of the object blanks are held symmetrically or asymmetrically on an object carrier of the marking object.

9. Marking device as claimed in claim 1, wherein the device for at least one of detection and influencing is adapted for interaction with identification means formed of at least one of an inscribing, an engraving, an embossing, perforations and an electronic data medium.

10. Marking device as claimed in claim 1, wherein the device for at least one of detection and influencing is adapted for interaction with identification means formed of an RFID (radio frequency identification) chip or magnetic strip.

11. Marking device as claimed in claim 1, wherein the device for at least one of detection and influencing is adapted for interaction with identification means indicating whether the identification means is located on the front side or the back side of the marking object.

* * * * *